US005679082A

United States Patent [19]

Hincke

[11] Patent Number: 5,679,082

[45] Date of Patent: Oct. 21, 1997

[54] SAUCER-SHAPED WATER SKIPPING DEVICE

[76] Inventor: Forrest G. Hincke, 4193 Hwy. 395 North, Kettle Falls, Wash. 99141

[21] Appl. No.: 662,214

[22] Filed: Jun. 12, 1996

[51] Int. Cl.[6] ..... A63B 65/10

[52] U.S. Cl. ..... 473/588

[58] Field of Search ..... 273/424, 425, 273/428, 417; 446/46–48; 473/588, 589

[56] References Cited

U.S. PATENT DOCUMENTS

| | | | |
|---|---|---|---|
| 3,544,113 | 12/1970 | Hand | 273/424 |
| 3,759,518 | 9/1973 | Mroz | 273/417 |
| 3,941,383 | 3/1976 | Clarke | 273/424 X |
| 4,262,911 | 4/1981 | Opresik et al. | 273/428 |
| 4,938,486 | 7/1990 | Graf | 273/424 |
| 5,014,990 | 5/1991 | Kaser et al. | 446/46 X |
| 5,078,637 | 1/1992 | McFarland | 273/424 X |

*Primary Examiner*—Paul E. Shapiro

[57] ABSTRACT

A saucer-shaped water skipping device including an upper disc and a lower disc with each disc having a concave shape formed of a lightweight and generally rigid material, each disc further having a central axis, an exterior surface, an interior surface, and a peripheral edge interconnecting the exterior surface and the interior surface; an annular flexible edging positioned in axial alignment with the disks; and a coupling mechanism for coupling the discs together with the edging positioned therebetween and in contact with the peripheral edges to create a saucer and with the edging having an exteriorly positioned outer portion serving as a grip for throwing the saucer to place it in flight and further serving as a bumper for cushioning the saucer when it strikes a recipient external object when in flight.

9 Claims, 4 Drawing Sheets

FIG. 5
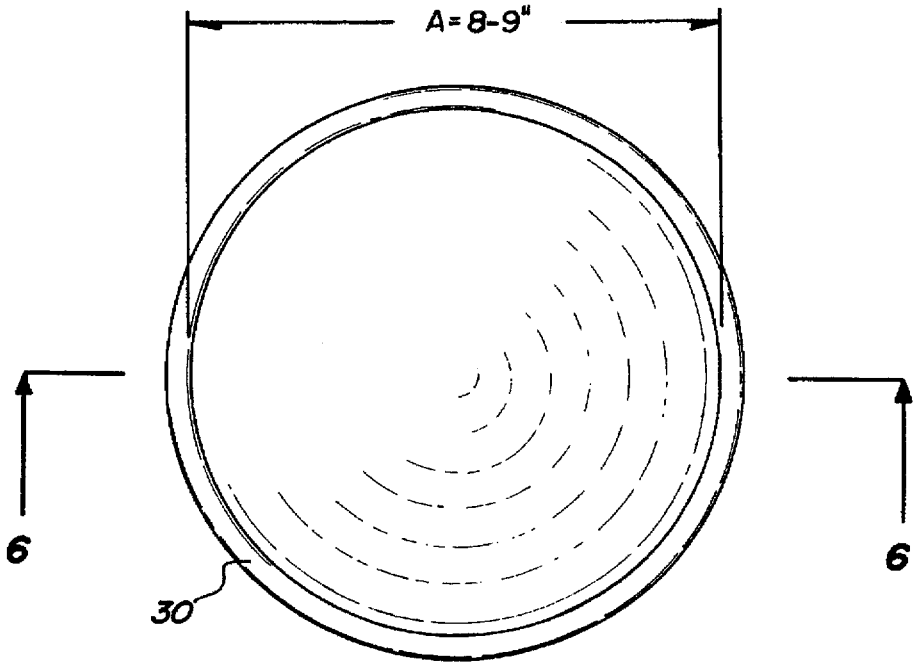
FIG. 9
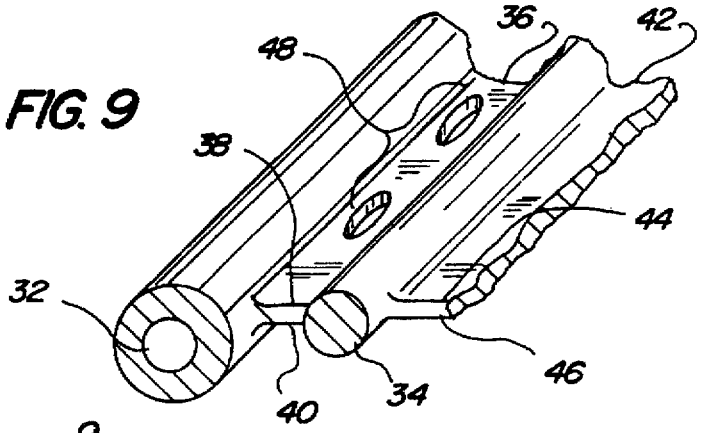
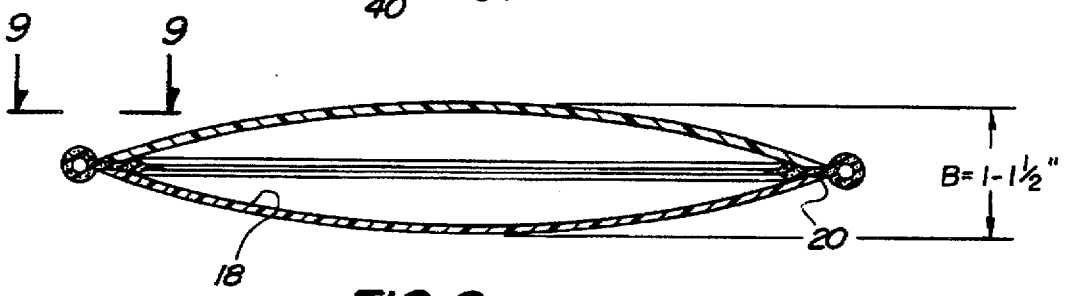
FIG. 6

SAUCER-SHAPED WATER SKIPPING DEVICE

BACKGROUND OF THE INVENTION

1. Field of the Invention

The present invention relates to a saucer-shaped water skipping device and more particularly pertains to skipping across the surface of a body of water with a saucer-shaped water skipping device.

2. Description of the Prior Art

The use of water skipping apparatuses is known in the prior art. More specifically, water skipping apparatuses heretofore devised and utilized for the purpose of skipping across a body of water are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,115,946 to Vukmirovich discloses a flexible discus device. U.S. Pat. No. 4,203,249 to Bohm discloses a flying saucer or throwing disc used in sports games. U.S. Pat. No. 4,894,038 to Giese discloses a frisbee disc and ball drop assembly. U.S. Pat. No. 5,078,637 to McFarland discloses a flexible flying disc with edge tube.

While these devices fulfill their respective, particular objective and requirements, the aforementioned patents do not describe a saucer-shaped water skipping device that is designed to readily skip across a body of water when thrown and has a soft flexible edge to facilitate its throwing and its catching.

In this respect, the saucer-shaped water skipping device according to the present invention substantially departs from the conventional concepts and designs of the prior art, and in doing so provides an apparatus primarily developed for the purpose of skipping across the surface of a body of water.

Therefore, it can be appreciated that there exists a continuing need for new and improved saucer-shaped water skipping device which can be used for skipping across the surface of a body of water. In this regard, the present invention substantially fulfills this need.

SUMMARY OF THE INVENTION

In the view of the foregoing disadvantages inherent in the known types of water skipping apparatuses now present in the prior art, the present invention provides an improved saucer-shaped water skipping device. As such, the general purpose of the present invention, which will be described subsequently in greater detail, is to provide a new and improved saucer-shaped water skipping device and method which has all the advantages of the prior art and none of the disadvantages.

To attain this, the present invention essentially comprises, in combination, an upper disc and a lower disc with each disc having a concave shape formed of a lightweight and generally rigid plastic material and with the discs being of equal size and shape. Each disc further has a central axis, an exterior surface, an interior surface, a fixed thickness, a peripheral edge interconnecting the exterior surface and the interior surface and with the peripheral edge of each disk contained in a separate horizontal plane. Each disc additionally has a radius extending from the central axis to an outer extent of the peripheral edge and with the radius being between about 4 to 4½ inches. An annular flexible rubber edging is included and positioned between the disks in axial alignment therewith. The edging has an outer ring with a tubular cross-section and an exterior diameter, an inner ring with a cylindrical cross-section and a diameter less than that of the outer ring, an inbound flat component having a thickness less than the diameter of the inner ring and extended radially inwards from the inner ring and toward the central axes of the discs, and a flat outbound component with a thickness equal to the inbound component that interconnects the rings. The outbound component further has two pairs of spaced and diametrically opposed oblong slots formed therethrough.

Lastly, a snap-type fastener assembly is provided. The assembly is formed of two pairs of diametrically opposed and spaced female connectors integral with and extended vertically downwards from the peripheral edge of the upper disk and two pairs of spaced and diametrically opposed male connectors integral with and extended upwards from the peripheral edge of the lower disk. Each male connector of the assembly is disposed through one of the slots and snapidly secured to one of the female connectors of the assembly to thereby place the peripheral edges of the discs in facing contact with the outbound component of the edging and to further couple the discs together to create a saucer. The saucer has a hollow interior and an axial length of between about 1 to 1½ inches. The outer ring of the edging is positioned exteriorly to the saucer and serves as a grip for throwing the saucer to place it in flight and further serves as a bumper for cushioning the saucer when it strikes a recipient external object when in flight.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved saucer-shaped water skipping device which has all the advantages of the prior art water skipping apparatuses and none of the disadvantages.

It is another object of the present invention to provide a new and improved saucer-shaped water skipping device which may be easily and efficiently manufactured and marketed.

It is a further object of the present invention to provide a new and improved saucer-shaped water skipping device which is of durable and reliable construction.

An even further object of the present invention is to provide a new and improved saucer-shaped water skipping device which is susceptible of a low cost of manufacture with regard to both materials and labor, and which accordingly is then susceptible of low prices of sale to the consuming public, thereby making such a saucer-shaped water skipping device economically available to the buying public.

Still yet another object of the present invention is to provide a new and improved saucer-shaped water skipping device which provides in the apparatuses and methods of the prior art some of the advantages thereof, while simultaneously overcoming some of the disadvantages normally associated therewith.

Even still another object of the present invention is to provide a new and improved saucer-shaped water skipping device for skipping across the surface of a body of water.

Lastly, it is an object of the present invention to provide a new and improved saucer-shaped water skipping device comprising an upper disc and a lower disc with each disc having a concave shape formed of a lightweight and generally rigid material, each disc further having a central axis, an exterior surface, an interior surface, and a peripheral edge interconnecting the exterior surface and the interior surface; an annular flexible edging positioned in axial alignment with the disks; and coupling means for coupling the discs together with the edging positioned therebetween and in contact with the peripheral edges to create a saucer and with the edging having an exteriorly positioned outer portion serving as a grip for throwing the saucer to place it in flight and further serving as a bumper for cushioning the saucer when it strikes a recipient external object when in flight.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a plan view of the preferred embodiment of the present invention.

FIG. 6 is a cross-sectional view of the present invention taken along the line 6—6 of FIG. 5.

FIG. 9 is a fragmentary view of the present invention taken along the line 9—9 of FIG. 6.

The same reference numerals refer to the same parts through the various Figures.

DESCRIPTION OF THE PREFERRED EMBODIMENT

Figure 1:
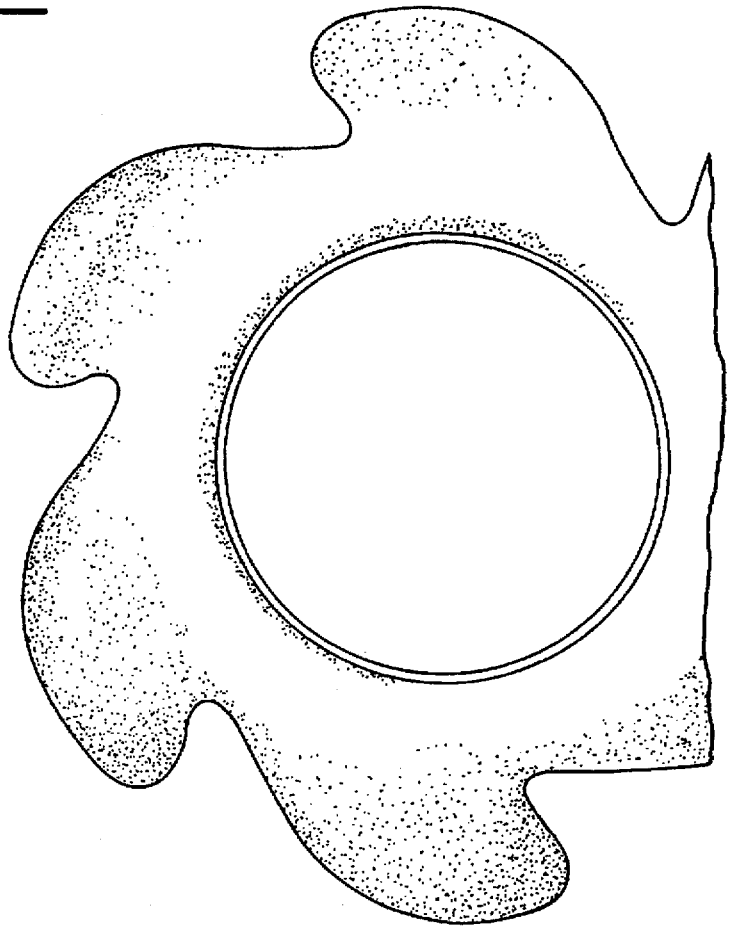
PRIOR ART FIG. 1
FIG. 1 is a plan view of a prior art flying saucer.
Figure 2:
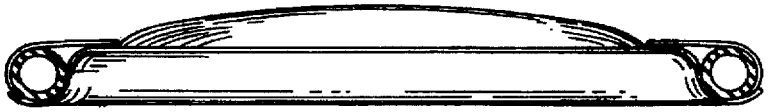
PRIOR ART FIG. 2
FIG. 2 is a cross-sectional view of another prior art flying saucer.
Figure 3:
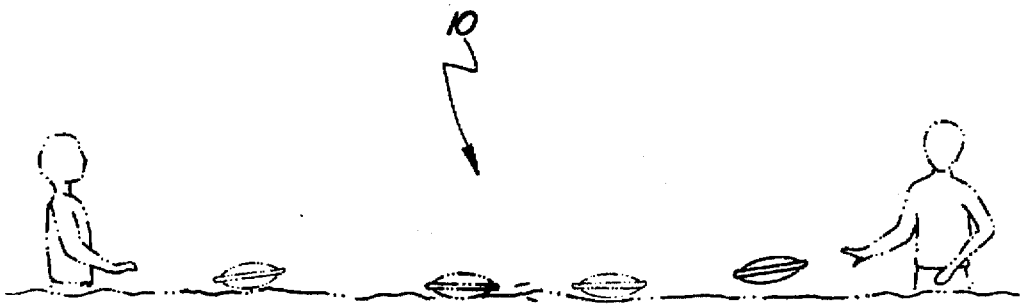
FIG. 3 is a side elevational view of the preferred embodiment being skipped across the surface of a body of water.
Figure 4:
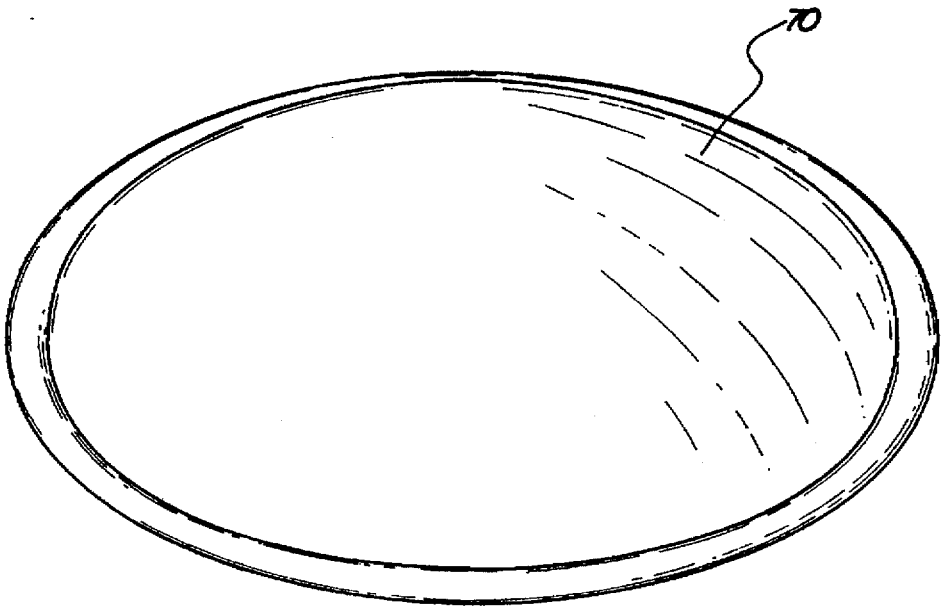
FIG. 4 is a perspective view of the preferred embodiment constructed in accordance with the principles of the present invention.
Figure 7:
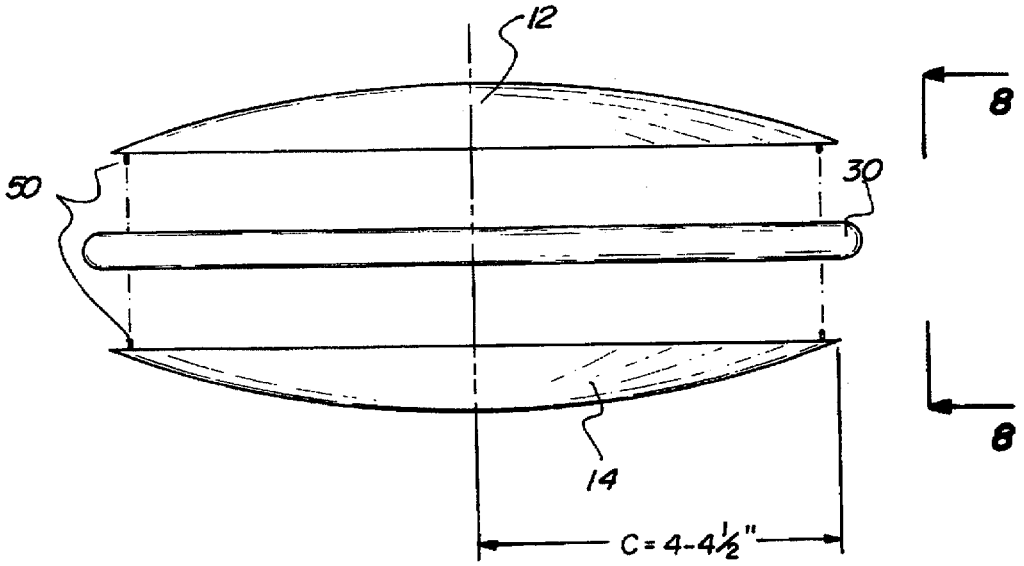
FIG. 7 is an exploded side elevational view of the preferred embodiment of the present invention.
Figure 8:
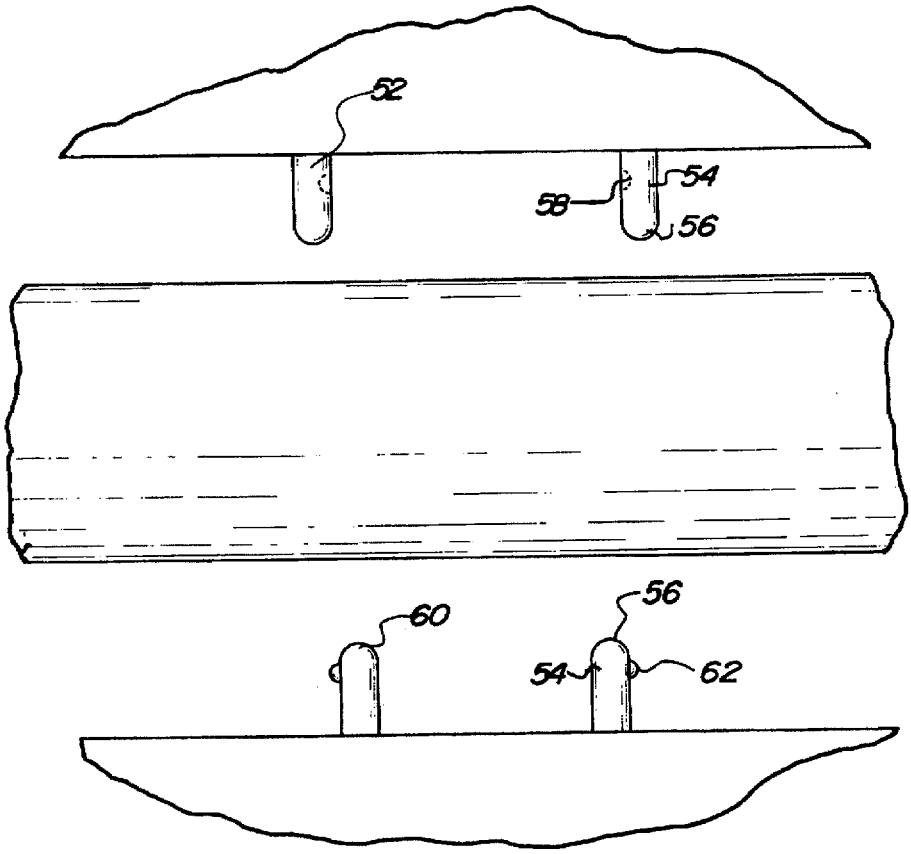
FIG. 8 is a fragmentary side elevational view of the present invention taken along the line 8—8 of FIG. 7.

With reference now to the drawings, the preferred embodiment of the new and improved saucer-shaped water skipping device embodying the principles and concepts of the present invention and generally designated by the reference number 10 will be described.

The preferred embodiment of the present invention comprises a plurality of components. In their broadest context, such components include a pair of discs, an edging, and a fastener assembly. Such components are individually configured and correlated with respect to each other to provide a structure used for skipping across a surface of a body of water for recreational purposes.

Specifically, the present invention includes an upper disc 12 and a lower disc 14. Each disc has a concave shape formed of a lightweight and generally rigid plastic material. The discs are of equal size and shape. Each disc further has a central axis, an exterior surface 16, an interior surface 18, a fixed thickness, and a peripheral edge 20 interconnecting the exterior surface 16 and the interior surface 18. The peripheral edge of each disc is contained in a separate horizontal plane. Each disc has a radius extending from the central axis to an outer extent of the peripheral edge 20. The radius is between about 4–4½ inches in length. The discs are positioned in opposition with their peripheral edges facing toward each other and with their central axis aligned.

An annular and flexible rubber edging 30 is provided. The edging 30 is positioned between and in axial alignment with the discs 12, 14. The edging has an outer ring 32. The outer ring has a tubular cross section with an exterior diameter. The edging also includes an inner ring 34. The inner ring 34 has a cylindrical cross-section with a diameter less than that of the outer ring 32. An inbound flat component 36 is extended radially inwards from the inner ring 34 toward the central axis of the disc 12, 14. The inbound flat component 36 has an upper surface 38, a lower surface 40, and a thickness as measured perpendicularly between the surfaces 38, 40. This thickness is less than the diameter of the inner ring 34. The edging also includes a flat outboard component 42 interconnecting the rings 32, 34. The outbound component 42 has an upper surface 44, a planar lower surface 46, and a thickness as measured perpendicularly between the surfaces 44, 46. This thickness is equal to the thickness of the inbound component 36. The outbound component is planarly aligned with the inbound component. The outbound component further has first pair of spaced and oblong slots 48 formed therethrough and a second pair of spaced and oblong slots formed therethrough. The pairs of slots are positioned in diametric opposition on the outbound component of the edging.

Lastly, a snap-type fastener assembly 50 is provided. The fastener assembly 50 is formed of two pairs of diametrically opposed and spaced female connectors 52. The female connectors are integral with and extended vertically downwards from the peripheral edge 20 of the upper disc 12. Each female connector is formed of a support post 54 terminated with a rounded tip 56. A generally hemispheric seat 58 is formed near the tip 56. The fastener assembly 60 also includes two pairs of spaced and diametrically opposed male connectors 60. Each male connector is integral with and extended upwards from the peripheral edge of the lower disc 14. Each male connector is formed of a support post 54 with a rounded tip 56. A spring-loaded detent 62 is coupled to each support post 56. The detent is positionable within a corresponding seat 56 formed on the female connector 52. Each male connector is disposed through one the slots 58 on the edging 30 and snapidly secured to one of the female connectors 52 to thereby place the peripheral edges 20 of the discs 12, 14 in facing contact with the upper and lower surface of the outbound component 40 of the edging. Furthermore, the rings hold the peripheral edges of the disks in an axially aligned configuration. The connectors couple the discs 12, 14 together to create a saucer 70. The saucer has a hollow interior and an axial length of between about 1 to 1½ inches. The outer ring 32 of the edging 30 is positioned exteriorly to the saucer 70. The outer ring 32 serves as a grip for throwing the saucer to place it in flight or for catching the saucer after placed in flight. The outer ring 32 further serves as a bumper for cushioning the saucer when it strikes a recipient external object when in flight or for damping its impact on a user's hand when caught.

The present invention is a recreational device designed for use when in the pool, or at the beach or lake. It comprises two plastic discs and a sealing rubber edging. Each of the disks is concave in shape with a diameter of approximately 8–9. The disks are positioned with concave surfaces facing each other to create a hollow interior and are secured in place by centrally projecting connectors that are snapidly pressed to each other. The soft flexible rubber edging is installed such that it projects outwards and around the outer periphery of the discs. The finished assembly broadly resembles the popular conception of a flying saucer. The aforementioned rubber ring serves three purposes—namely, to seal the interior cavity of the present invention, to protect users who try to catch the saucer in flight, and to afford a more positive grip to anyone throwing the saucer.

The present invention is used in much the same fashion as a popular frisbee, except that it can be used while in the water. The present invention is designed to skip over the surface of a body of water with a series of hops. This same effect can be obtained when one scales a flat rock across the surface of a body of water. The present invention allows a user to perform the same type of skipping action. The present invention also has a structure that allows it to be returned in the same manner by another user. The present invention provides hours of fun when used in a pool or any other swimming area.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A saucer-shaped water skipping device for skipping across a surface of a body of water comprising, in combination:

an upper disc and a lower disc with each disc having a concave shape formed of a lightweight and generally rigid plastic material and with the discs being of equal size and shape, each disc further having a central axis, an exterior surface, an interior surface, a fixed thickness, a peripheral edge interconnecting the exterior surface and the interior surface and with the peripheral edge of each disk contained in a separate horizontal plane, each disc additionally having a radius extending from the central axis to an outer extent of the peripheral edge and with the radius being between about 4 to 4½ inches;

an annular flexible rubber edging positioned between the disks and in axial alignment therewith, the edging having an outer ring with a tubular cross-section and an exterior diameter, an inner ring with a cylindrical cross-section and a diameter less than that of the outer ring, an inbound flat component having a thickness less than the diameter of the inner ring and extended radially inwards from the inner ring and toward the central axes of the discs, and a flat outbound component with a thickness equal to the inbound component interconnecting the rings and with the outbound component further having two pairs of spaced and diametrically opposed oblong slots formed therethrough; and a snap-type fastener assembly formed of two pairs of diametrically opposed and spaced female connectors integral with and extended vertically downwards from the peripheral edge of the upper disk and two pairs of spaced and diametrically opposed male connectors integral with and extended upwards from the peripheral edge of the lower disk and with each male connector disposed through one of the slots and snapidly secured to one of the female connectors to thereby place the peripheral edges of the discs in facing contact with the outbound component of the edging and couple the discs together to create a saucer having a hollow interior and an axial length of between about 1 to 1½ inches and with the outer ring of the edging positioned exteriorly to the saucer and serving as a grip for throwing the saucer to place it in flight and further serving as a bumper for cushioning the saucer when it strikes a recipient external object when in flight.

2. A saucer-shaped water skipping device comprising:

an upper disc and a lower disc with each disc having a concave shape formed of a lightweight and generally rigid material, each disc further having a central axis, an exterior surface, an interior surface, and a peripheral edge interconnecting the exterior surface and the interior surface;

an annular flexible edging positioned in axial alignment with the disks, the edging having an outer ring with a tubular cross-section and a flat inbound component connected to the outer ring, with the inbound component having at least one pair of spaced slots formed therethrough; and coupling means including at least one male connector and at least one female connector adapted to couple together through the slots of the flexible edging for coupling the discs together with the edging positioned therebetween to create a saucer and with the edging having an exteriorly positioned outer portion serving as a grip for throwing the saucer to place it in flight and further serving as a bumper for cushioning the saucer when it strikes a recipient external object when in flight.

3. The saucer-shaped water skipping device as set forth in claim 2 wherein the discs are of equal size and shape.

4. The saucer-shaped water skipping device as set forth in claim 2 wherein each disc has a fixed thickness.

5. The saucer-shaped water skipping device as set forth in claim 2 wherein the peripheral edge of each disc is contained in a separate horizontal plane.

6. The saucer-shaped water skipping device as set forth in claim 2 wherein each disc has a diameter of about 8 to 9 inches.

7. The saucer-shaped water skipping device as set forth in claim 2 wherein the edging further comprises an inner ring, and the inbound component interconnects the rings.

8. The saucer-shaped water skipping device as set forth in claim 2 wherein the coupling means comprises a plurality of connectors coupled to and extended downwards from the upper disc a plurality of complementary connectors coupled to and extended upwards from the lower disc and with the connectors of the discs removably securable together.

9. The saucer-shaped water skipping device as set forth in claim 2 wherein the saucer has an axial length of between about 1 to 1½ inches.

* * * * *